US010658791B2

(12) United States Patent
Chiang et al.

(10) Patent No.: US 10,658,791 B2
(45) Date of Patent: May 19, 2020

(54) CONNECTION MODULE AND CONNECTOR STRUCTURE

(71) Applicant: BO-JIANG TECHNOLOGY CO., LTD., Tainan (TW)

(72) Inventors: Chang-Hui Chiang, Tainan (TW); Jia-Ping Chen, Tainan (TW)

(73) Assignee: BO-JIANG TECHNOLOGY CO., LTD., Tainan (TW)

( * ) Notice: Subject to any disclaimer, the term of this patent is extended or adjusted under 35 U.S.C. 154(b) by 0 days.

(21) Appl. No.: 16/216,331

(22) Filed: Dec. 11, 2018

(65) Prior Publication Data

US 2020/0044387 A1 Feb. 6, 2020

(30) Foreign Application Priority Data

Aug. 3, 2018 (TW) ..... 107210658 U

(51) Int. Cl.

| | |
|---|---|
| ***H01R 4/50*** | (2006.01) |
| ***H01R 13/627*** | (2006.01) |
| ***H01R 24/64*** | (2011.01) |
| ***H01R 24/20*** | (2011.01) |

(52) U.S. Cl.

CPC ..... *H01R 13/627* (2013.01); *H01R 24/20* (2013.01); *H01R 24/64* (2013.01)

(58) Field of Classification Search

CPC .. H01R 24/44; H01R 13/6276; H01R 13/623; H01R 13/627; H01R 24/64; H01R 24/20

USPC ..... 439/345

See application file for complete search history.

(56) References Cited

U.S. PATENT DOCUMENTS

| | | | | |
|---|---|---|---|---|
| 3,470,524 A * | 9/1969 | Culver | H01R 13/623 | 439/317 |
| 6,875,037 B2 * | 4/2005 | Collin | H01R 13/6276 | 439/317 |
| 7,681,925 B2 * | 3/2010 | Lambert | F16L 37/248 | 285/316 |
| 8,449,326 B2 * | 5/2013 | Holland | H01R 24/44 | 439/578 |
| 8,899,550 B2 * | 12/2014 | Tiberghien | F16L 31/00 | 137/614.04 |

* cited by examiner

*Primary Examiner* — Jean F Duverne
(74) *Attorney, Agent, or Firm* — Li & Cai Intellectual Property (USA) Office

(57) ABSTRACT

A connection module and a connector structure are provided. The connector structure includes a connection module and a joint module. The connection module includes a first joint unit, a connection unit having one end detachably connected to the first joint unit and the other end having fasteners, and a limit unit sleeved on the connection unit. The outer edge of each of the fasteners protrudes outward to form a top abutment portion. The joint module includes a second joint unit and a guide unit detachably connected to the second joint unit and having a joint portion. The guide unit is a hollow structure. The connection module is detachably connected to the joint portion through the connection unit to connect with the joint module. The fasteners are movably abutted against the joint portion through the top abutment portions. The limit unit is abutted against the joint portion.

8 Claims, 17 Drawing Sheets

CONNECTION MODULE AND CONNECTOR STRUCTURE

CROSS-REFERENCE TO RELATED PATENT APPLICATION

This application claims the benefit of priority to Taiwan Patent Application No. 107210658, filed on Aug. 3, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connection module and a connector structure, and more particularly to a connection module and a connector structure that can be firmly combined.

BACKGROUND OF THE DISCLOSURE

In submarine cables, underground cables, cable TV or network transmission systems, the coaxial cable is mostly used as a medium for transmitting signals, especially in the transmission of voice, video and network. The coaxial cable is a cable having a copper conductor wrapped with layers of insulating material and achieves signal transmission by connecting a male connector with a female connector.

Nowadays, in pursuit of miniaturization and high-speed bandwidth, the male connector and the female connector share only a small contact area but still have to transmit at high frequency. Therefore, when the coaxial cable is shaken or vibrated, a separation force between the male connector and the female connector is generated so that the male and female connectors may loosen or have poor contact from each other. Accordingly, the coaxial cable has issues of poor signal transmission or interruption of signal transmission, which may further affect the signal transmission quality.

SUMMARY OF THE DISCLOSURE

In response to the above-referenced technical inadequacies, the present disclosure provides a connection module and a connector structure.

In one aspect, the present disclosure provides a connector structure including a connection module and a joint module. The connection module includes a first joint unit, a connection unit having one end detachably connected to the first joint unit and the other end having a plurality of fasteners, and a limit unit sleeved on the connection unit. The outer edge of each of the plurality of fasteners protrudes outward to form a top abutment portion. The joint module includes a second joint unit and a guide unit detachably connected to the second joint unit and having a joint portion. The guide unit is a hollow structure. The connection module is detachably connected to the joint portion through the connection unit so as to connect with the joint module, and the plurality of fasteners are movably abutted against the joint portion through the top abutment portions, and the limit unit is abutted against the joint portion.

In one aspect, the present disclosure provides a connection module including a first joint unit, a connection unit, and a limit unit. The connection unit has one end detachably connected to the first joint unit and the other end having a plurality of fasteners. The limit unit is sleeved on the connection unit. The connection module is detachably connected to a joint portion of a joint module through the connection unit so as to connect with the joint module, the plurality of fasteners are movably abutted against the joint portion and the limit unit is abutted against the joint portion.

Therefore, one of the beneficial effects of the present disclosure is that, with the technical solution of "providing a connection module including a first joint unit, a connection unit having one end detachably connected to the first joint unit and the other end having a plurality of fasteners, and a limit unit sleeved on the connection unit; wherein the outer edge of each of the plurality of fasteners protrudes outward to form a top abutment portion," "providing a joint module including a second joint unit and a guide unit detachably connected to the second joint unit and having a joint portion" and "the connection module being detachably connected to the joint portion through the connection unit so as to connect with the joint module, and the plurality of fasteners being abutted against the joint portion through the top abutment portions, and the limit unit being abutted against the joint portion," the connection module and the connector structure provided by the present disclosure enable the connection module and the joint module to be firmly engaged with each other, thereby improving the rate and quality of signal transmission.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
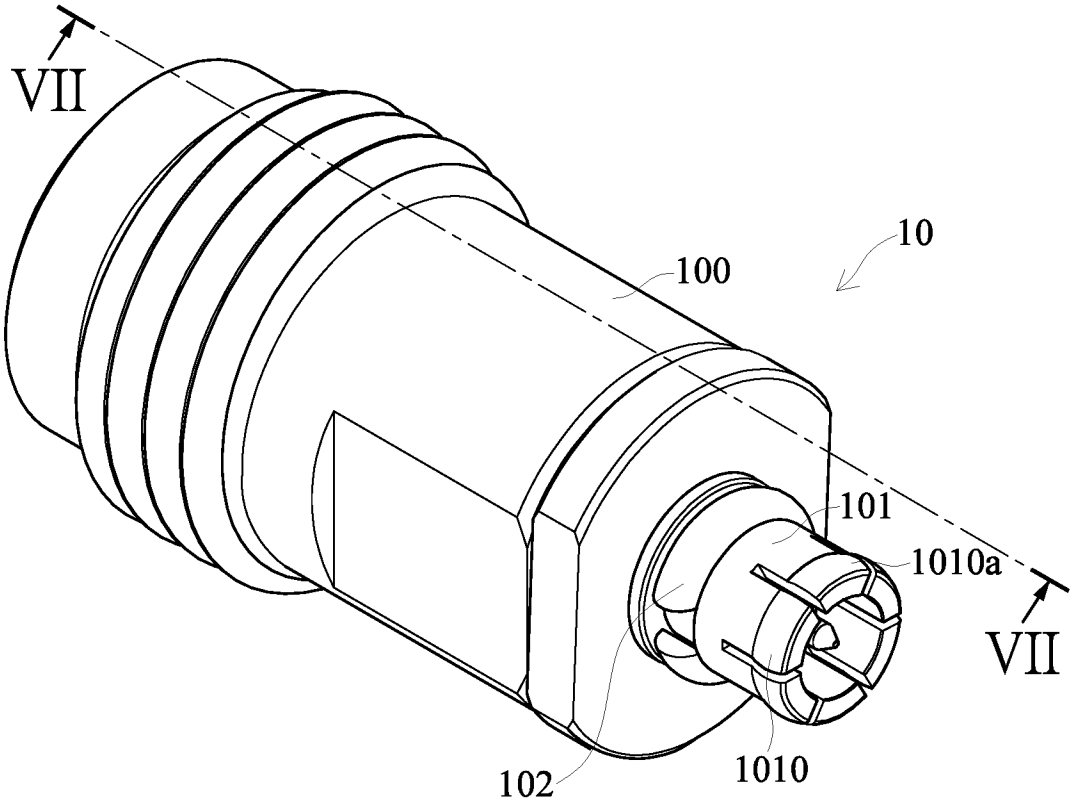
FIG. 1 is a perspective view of a connection module of a connector structure according to a first embodiment of the present disclosure.
Figure 2:
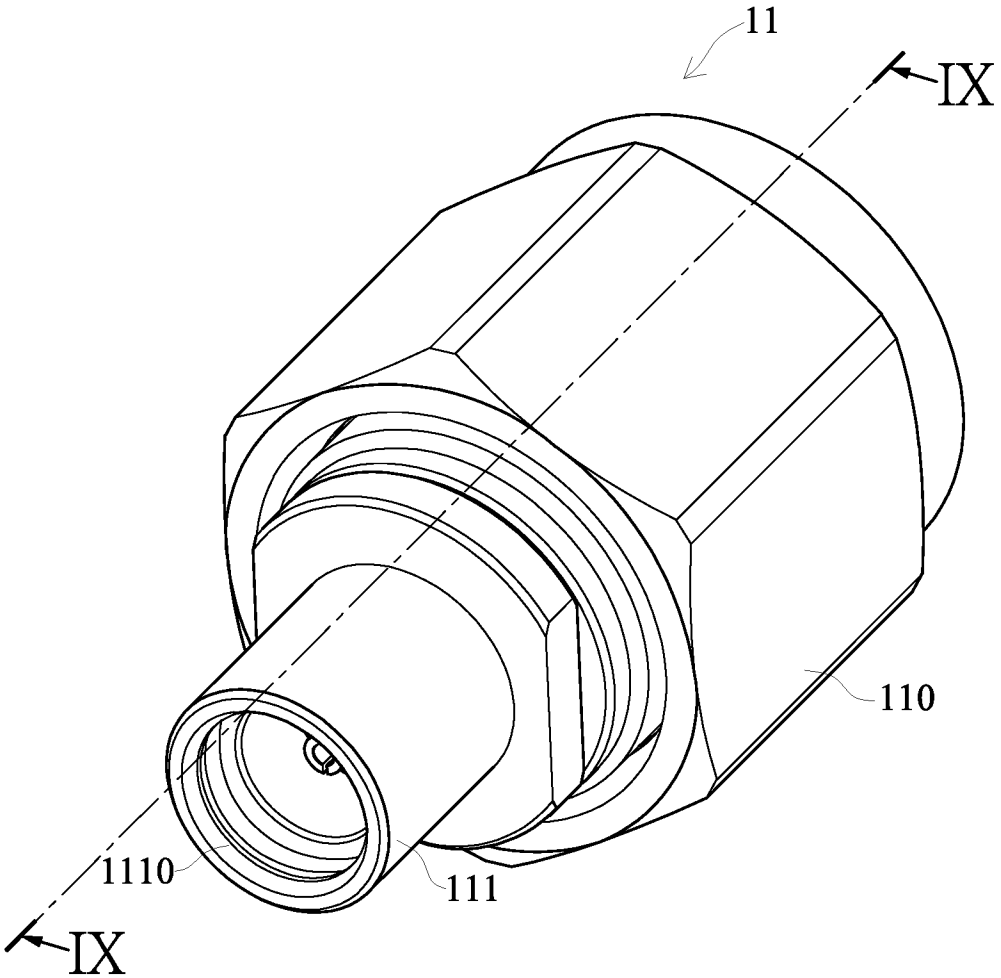
FIG. 2 is a schematic view of a joint module of the connector structure according to the first embodiment of the present disclosure.
Figure 3:
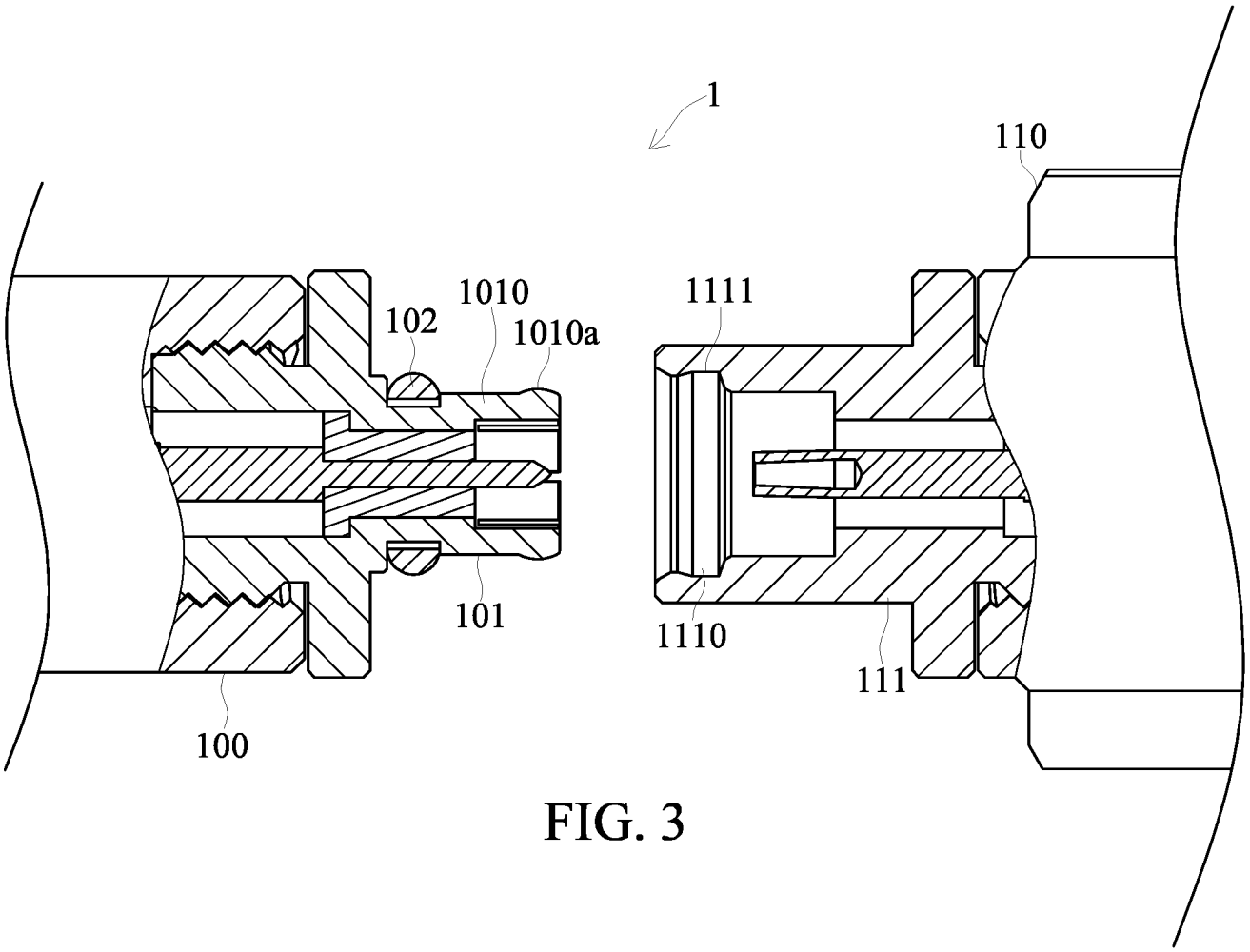
FIG. 3 is a cross-sectional view of the connector structure according to the first embodiment of the present disclosure.
Figure 4:
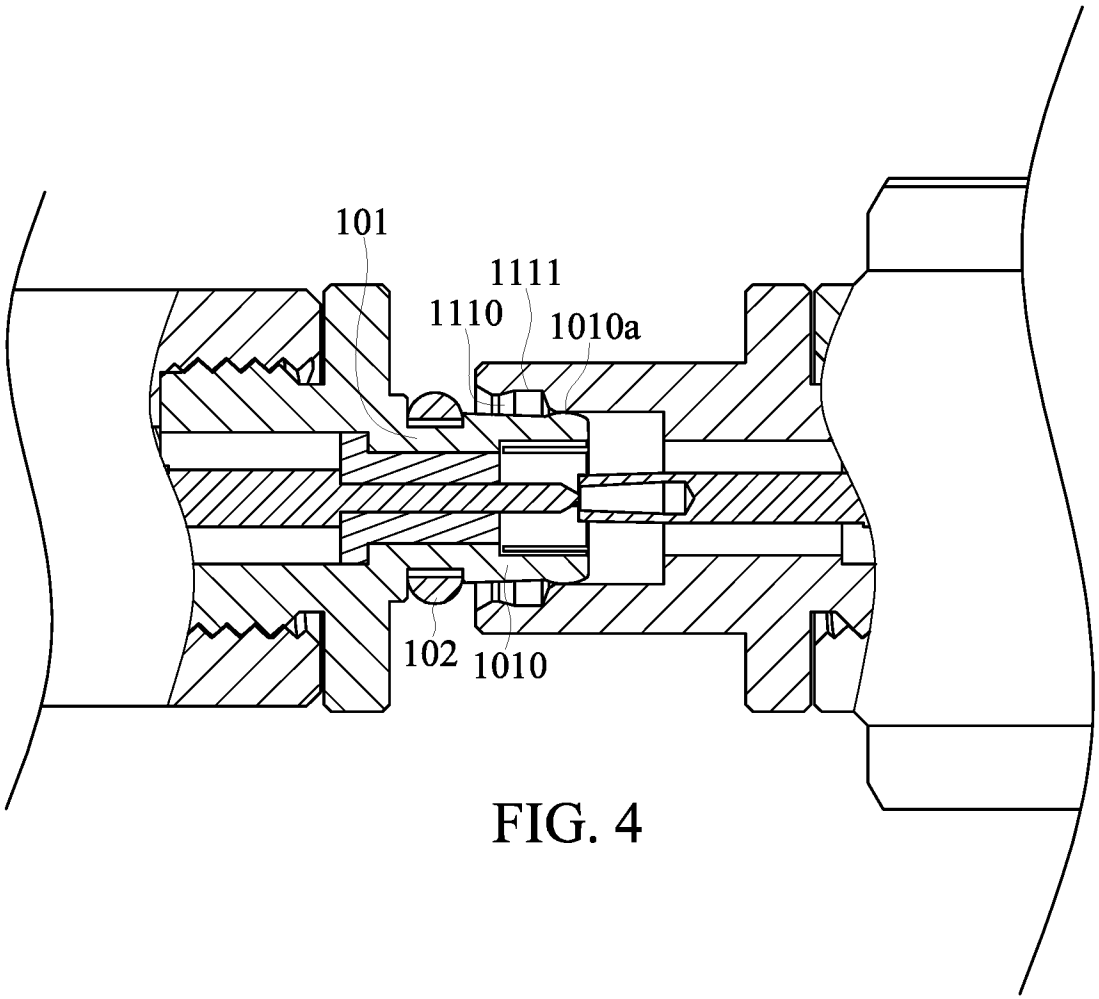
FIG. 4 is a cross-sectional view of the connector structure according to the first embodiment of the present disclosure.
Figure 5:
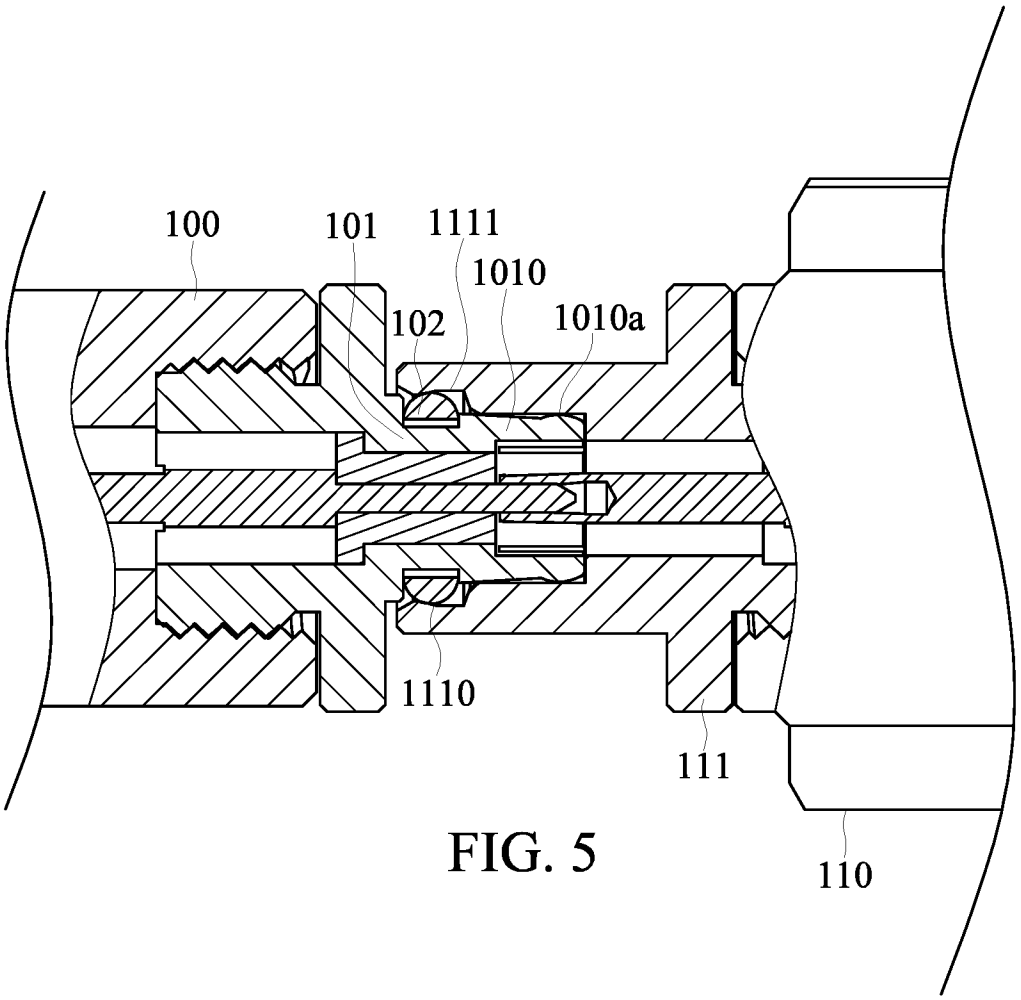
FIG. 5 is a cross-sectional view of the connector structure according to the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

FIG. 1 to FIG. 7 are respectively a perspective view of a connection module, a schematic view of a joint module, cross-sectional views of the connection module, and graphs of signal transmission data of a connector structure according to a first embodiment of the present disclosure. As shown in FIG. 1 to FIG. 7, the present disclosure provides a connector structure 1 includes a connection module 10 and a joint module 11. The connection module 10 includes a first joint unit 100, a connection unit 101 having one end detachably connected to the first joint unit 100 and the other end having a plurality of fasteners 1010, and a limit unit 102 sleeved on the connection unit 101. The outer edge of each of the plurality of fasteners 1010 protrudes outward to form a top abutment portion 1010*a*. The joint module 11 includes a second joint unit 110, and a guide unit 111 detachably connected to the second joint unit 110 and having a joint portion 1110, and the guide unit 111 is a hollow structure. The connection module 10 is detachably connected to the joint portion 1110 through the connection unit 101 so as to connect with the joint module 11, the plurality of fasteners 1010 are abutted against the joint portion 1110 through the top abutment portions 1010*a*, and the limit unit 102 is abutted against the joint portion 1110.

Specifically, the connector structure 1 provided by present disclosure includes the connection module 10 and the joint module 11, which can be a male connector and a female connector applied to a transmission cable. The connection module 10 further includes the first joint unit 100, the connection unit 101 and the limit unit 102. The connection unit 101 has one end detachably connected to the first joint unit 100 and the other end having the plurality of fasteners 1010 (which may be clamp-shaped, but not limited thereto). The connection unit 101 may be made of metal or plastic but is not limited thereto. The limit unit 102 may be sleeved on the connection unit 101. The limit unit 102 is a C-shaped structure but is not limited thereto. The joint module 11 may include the second joint unit 110 and the guide unit 111. The guide unit 111 may be detachably connected to the second joint unit 110. The guide unit 111 is a hollow structure and has the recessed joint portion 1110.

Therefore, the connection module 10 is engaged with the joint module 11 by connecting the connection unit 101 with the joint portion 1110 of the guide unit 111. During connection of the connection unit 101 with the joint portion 1110, the plurality of fasteners 1010 of the connection unit 101 are elastically moved inward due to the abutment against the joint portion 1110 of the guide unit 111. On the other hand, the plurality of fasteners 1010 can be abutted against the joint portion 1110 by the top abutment portions 1010*a* thereof with the elastic restoring force, thereby being firmly engaged with the joint portion 1110. In addition, since the limit unit 102 and the joint portion 1110 are axially compressed, the limit unit 102 is firmly engaged with the joint portion 1110, so that the connection unit 101 and the guide unit 111 are firmly engaged. Preferably, the joint portion 1110 has a positioning groove 1111 near an opening. When the connection unit 101 is engaged with the joint portion 1110, the limit unit 102 is firmly engaged with the positioning groove 1111.

Accordingly, the connector structure 1 provided by the present disclosure can improve the stability of the engagement of the connection module 10 and the joint module 11 through the connection unit 101 and the guide unit 111, such that the frequency range of the connector structure 1 can be in a high frequency range of DC to 67 GHz.

Figure 6:
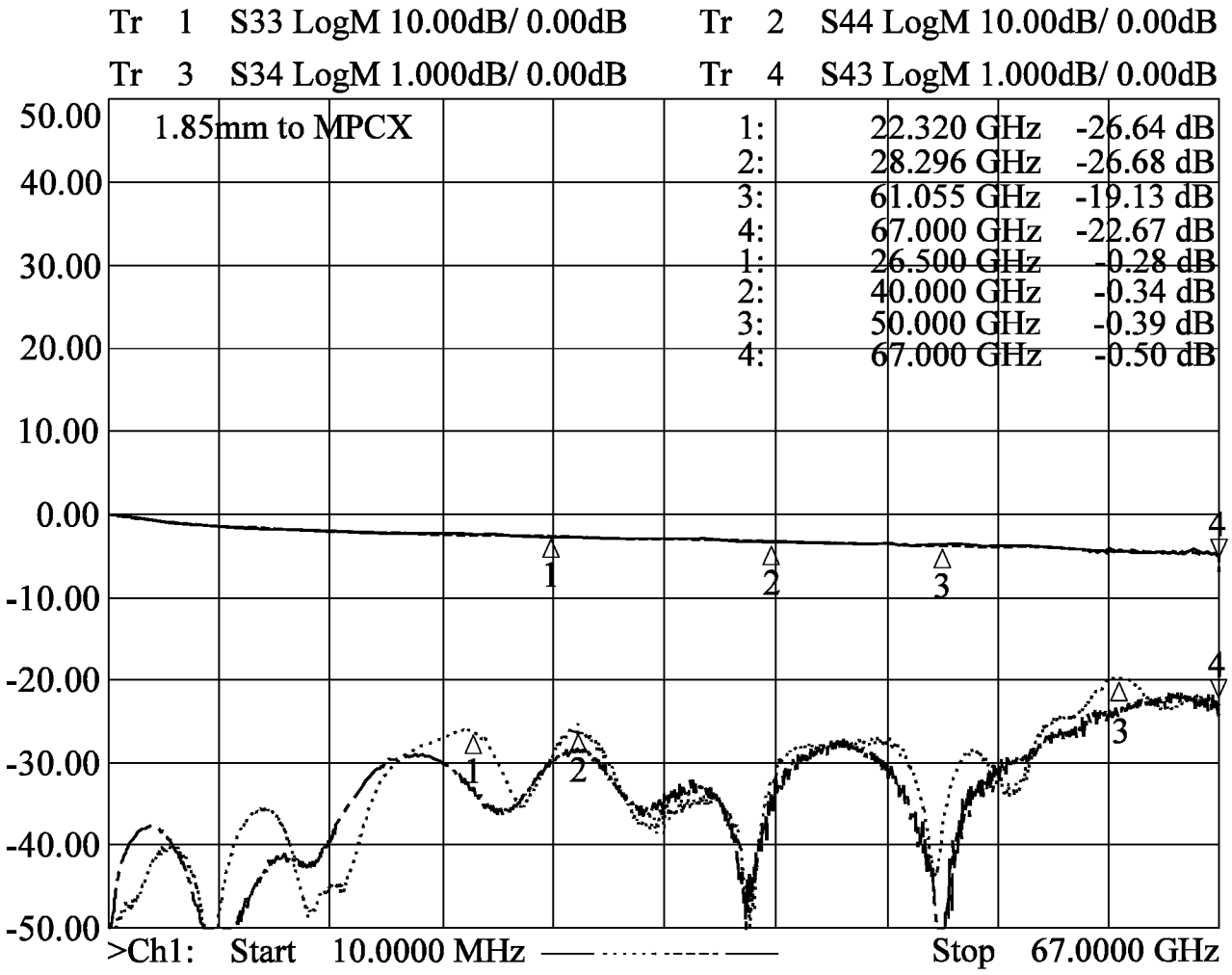
FIG. 6 is a graph of signal transmission data of the connector structure according to the present disclosure.
Figure 7:
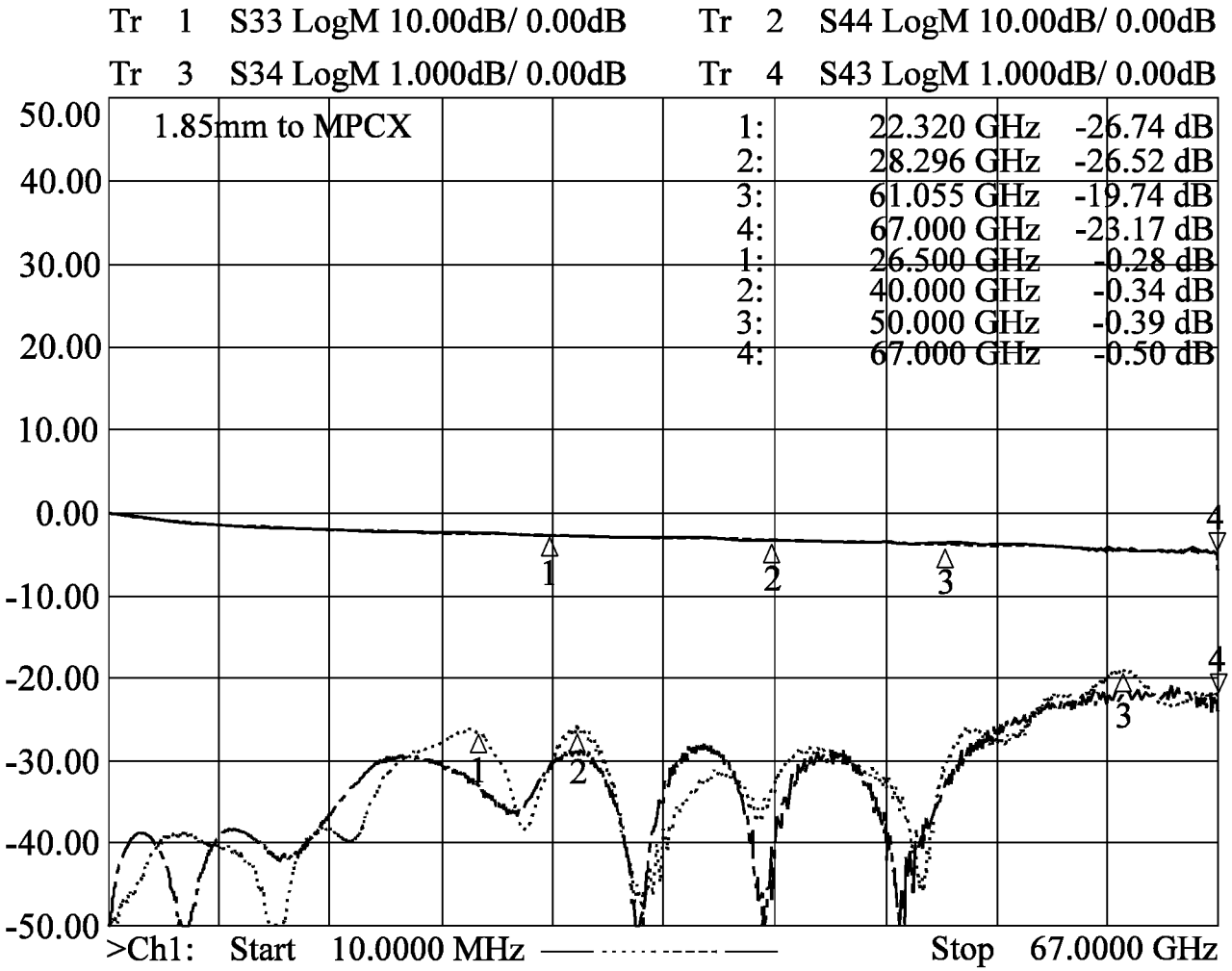
FIG. 7 is a graph of signal transmission data of the connector structure according to the present disclosure.

Further, referring to FIG. 6 and FIG. 7, the present disclosure provides two connector structures 1 with a specification of 1.85 mm for transmission frequency test. In the graphs, the vertical axis represents the amplitude difference and the horizontal axis represents the transmission frequency; Tr 1 and Tr 2 represent the reflection loss during signal transmission and Tr 3 and Tr 4 represent the penetration loss during signal transmission with the connector structure 1. Since the structures of the connection module 10 and the joint module 1 are different, Tr 1 and Tr 2 do not overlap in the reflection loss test and thus numbers 1 to 4 are marked according to the peak of Tr 2. On the contrary, in the penetration loss test, the difference between Tr 3 and Tr 4 is small or none, and thus 1 to 4 are marked according to the peak of Tr 3.

Since the penetration loss of each of the connection module 10 and the joint module 11 is −0.25 dB during signal transmission, the reflection loss thereof is lower than −20 dB. According to the curve representing Tr 2, it is understandable that when the transmission frequency is raised to 67 GHz, the reflection loss of the connector structure 1 of the present disclosure can be maintained within −20 dB. In addition, according to the curve representing Tr 3, it is understandable that when the transmission frequency is raised to 67 GHz, the penetration loss of the connector structure 1 of the present disclosure can be maintained at −0.25 dB. Based on the above, with the structural design of the limit unit 102, the fasteners 1010 and the top abutment portions 1010*a*, the transmission frequency of the connector structure 1 of the present disclosure can be greatly increased to 67 GHz compared with the conventional connectors.

It is worth mentioning that although the implementations, advantages and effects of the present disclosure can be understood by referring to the above descriptions, the above descriptions are merely one of the embodiments of the present disclosure and are not intended to limit the present disclosure.

Second Embodiment

Figure 8:
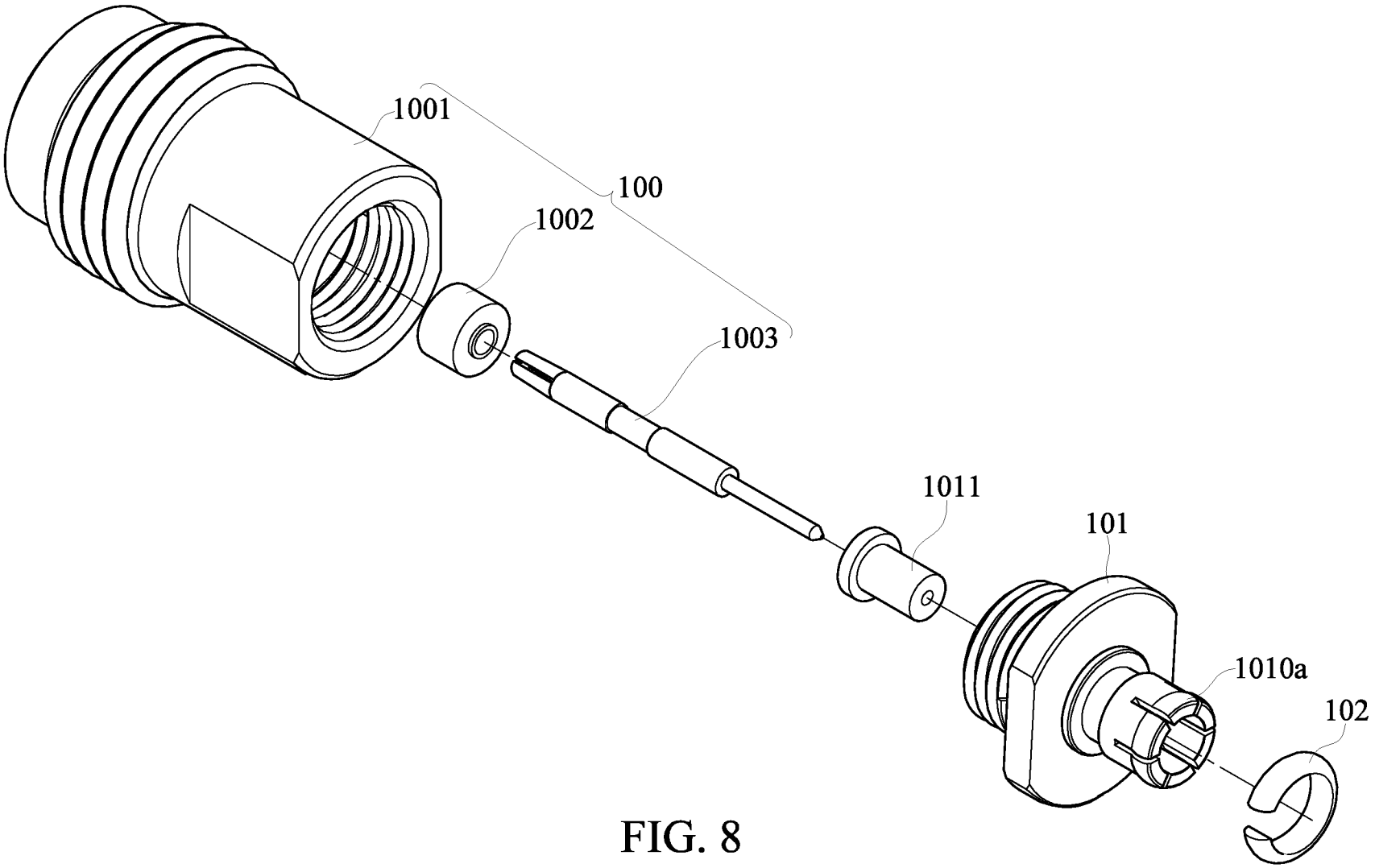
FIG. 8 is an exploded view of a connection module of a connector structure according to a second embodiment of the present disclosure.
Figure 9:
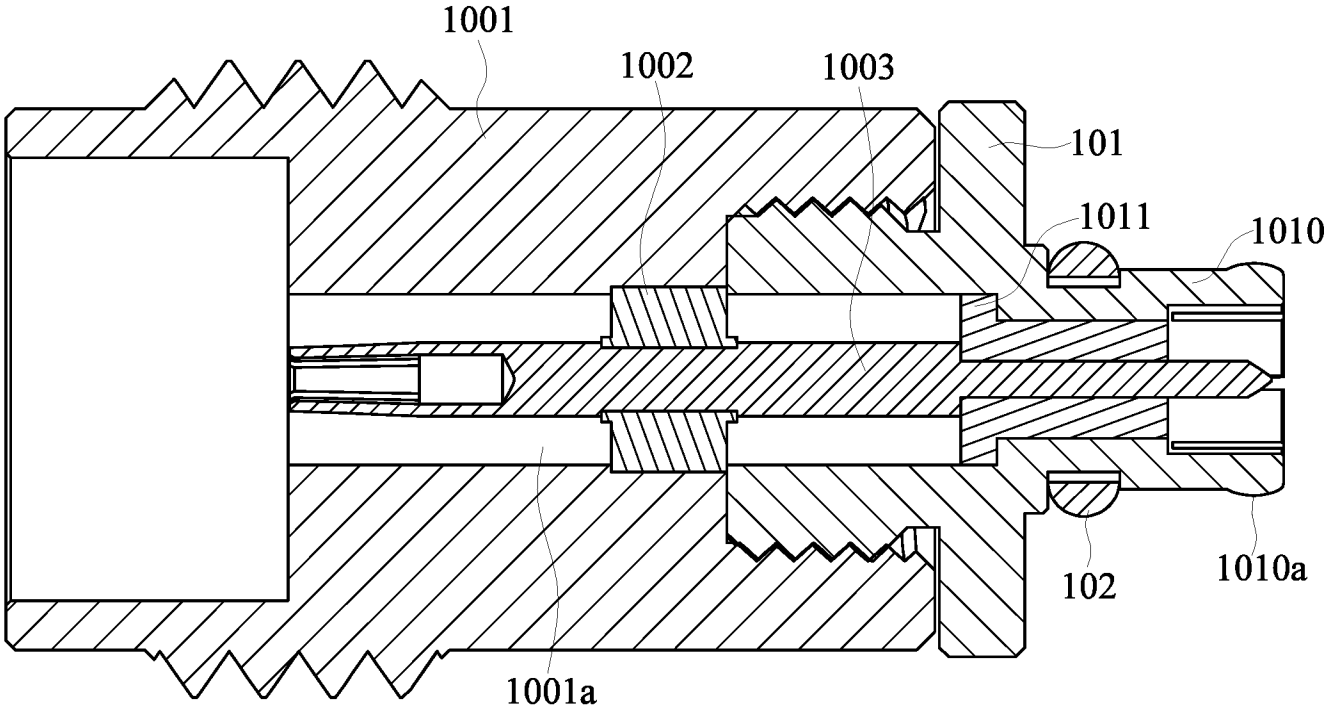
FIG. 9 is a cross-sectional view of the connection module of the connector structure according to the second embodiment of the present disclosure, which can be a cross-sectional view taken along line VII-VII of FIG. 1.

FIG. 8 and FIG. 9 are respectively an exploded view and a cross-sectional view of a connection module of a connector structure according to a second embodiment of the present disclosure. Referring to FIG. 8 and FIG. 9 in conjunction with FIG. 1 to FIG. 7, the same components in the connector structure of this embodiment and those in the connector structure of the above first embodiment have the same manners of operation, and details thereof will be omitted herein. It should be noted that in this embodiment, the connection unit 101 is a hollow structure, and the connection unit 101 has a first fixing member 1001, which is a hollow structure. The first joint unit 100 includes a first main body member 1001, a second fixing member 1002 and a first contact member 1003. The first main body member 1001 has a passage 1001*a*, the first main body member 1001 is detachably connected to the connection unit 101, and the passage 1001*a* communicates with the inside of the connection unit 101. The second fixing member 1002 is located in the passage 1001*a*. The first contact member 103 is movably disposed at the first fixing member 1011 and the second fixing member 1002.

For instance, the connection unit 101 of the connector structure 1 of the present disclosure may be a hollow structure and have the first fixing member 1011 inside. The first joint unit 100 may further include the first main body member 1001, the second fixing member 1002 and the first contact member 103. The first main body member 1001 may be a hollow structure and have the passage 1001*a*. The first main body member 1001 is detachably connected to the connection unit 101 through a screw or other locking structures, and the passage 1001*a* communicates with the inside of the connection unit 101. The first main body member 1001 may be made of metal or plastic but is not limited thereto. The second fixing member 1002 may be an annular member located in the passage 1001*a* of the first main body member 1001. The first contact member 103 may be a metal conductor disposed at the first fixing member 1011 and the second fixing member 1002 and located in the first main body member 1001 and the connection unit 101.

Therefore, the first joint unit 100 is connected to the joint portion 1110 of the guide unit 111 through the connection unit 101 and uses the top abutment portions 1010*a* of the plurality of fasteners 1010 of the connection unit 101 to be abutted against the joint portion 1110 so as to be firmly engaged with the joint portion 1110 through the limit unit 102. Accordingly, the first joint unit 100 is firmly engaged with the joint module 11.

It is worth mentioning that although the implementations, advantages and effects of the present disclosure can be understood by referring to the above descriptions, the above descriptions are merely one of the embodiments of the present disclosure and are not intended to limit the present disclosure.

Third Embodiment

Figure 10:
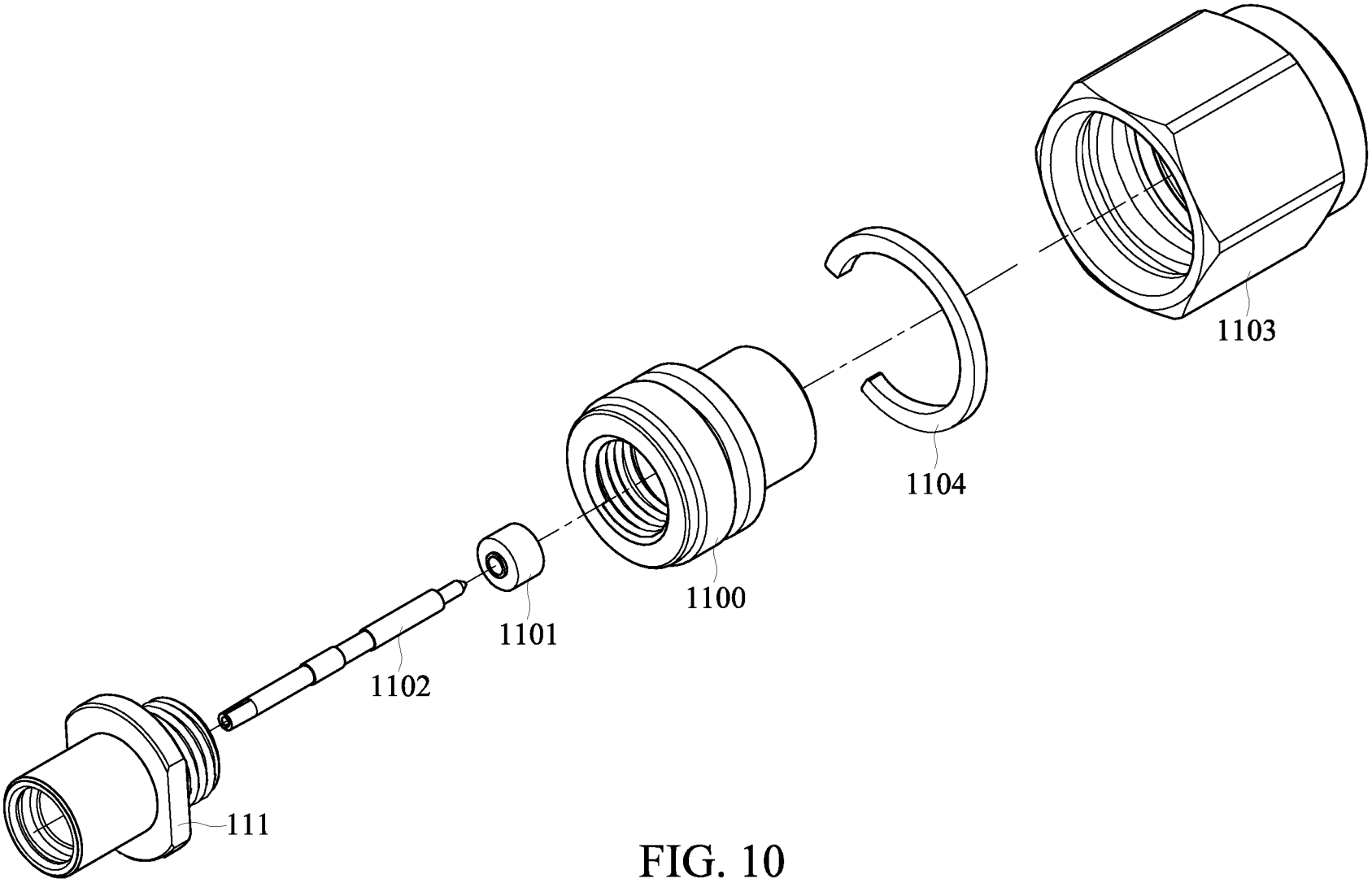
FIG. 10 is an exploded view of a joint module of a connector structure according to a third embodiment of the present disclosure.
Figure 11:
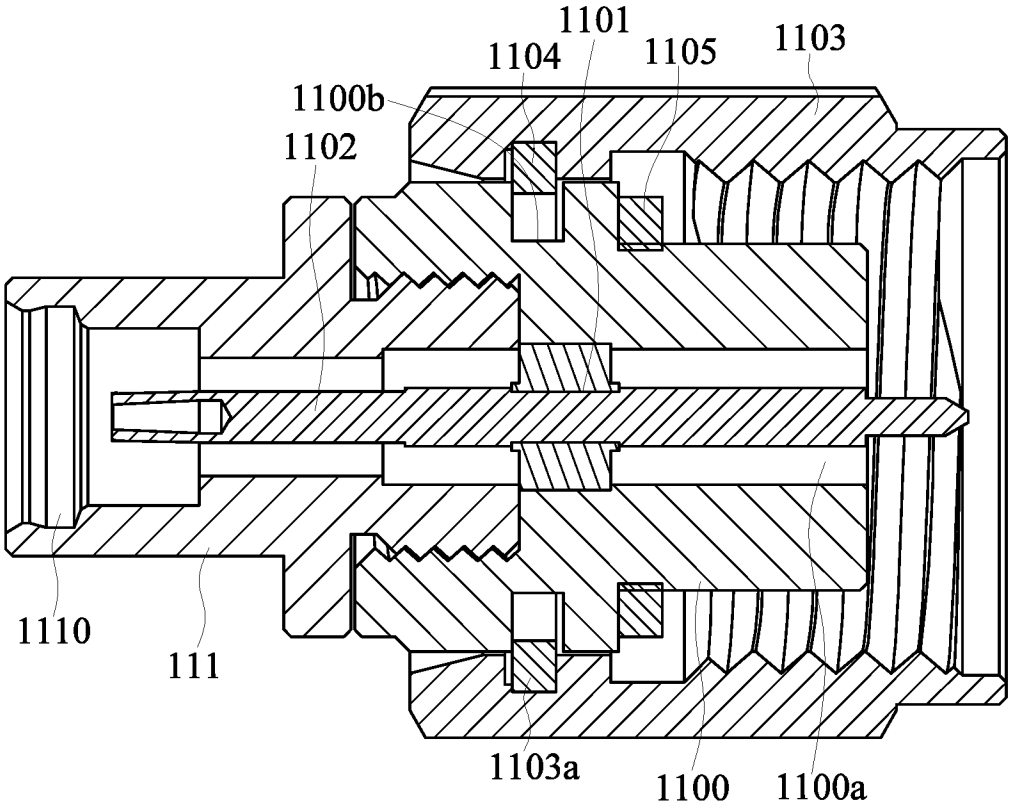
FIG. 11 is a cross-sectional view of the joint module of the connector structure according to the third embodiment of the present disclosure, which can be a cross-sectional view taken along line IX-IX of FIG. 2.

FIG. 10 and FIG. 11 are respectively an exploded view and a cross-sectional view of a joint module of a connector structure according to a third embodiment of the present disclosure. Referring to FIG. 10 and FIG. 11 in conjunction with FIG. 1 to FIG. 9, the same components in the connector structure of this embodiment and those in the connector structure of the above embodiments have similar manners of operation, and details thereof will be omitted herein. It should be noted that in this embodiment, the second joint unit 110 includes a second main body member 1110, a positioning member 1101, a second contact member 1102, a sleeve member 1103 and a buckle member 1104. The second main body member 1100 has a through passage 1100*a* at the center. The outer edge of the second main body member 1100 has a groove 1100*b*, and the second main body member 1100 is detachably connected to the guide unit 111. The through passage 1100*a* communicates with the inside of the guide unit 111. The positioning member 1101 is located in the through passage 1100*a*. The second contact member 1102 is disposed at the positioning member 1101 and inside the through passage 1100*a* and the guide unit 111. The sleeve member 1103 covers a portion of the second main body member 1100 and has a fastening groove 1103*a* at the inner wall surface thereof. The buckle member 1104 is located at the groove 1100*b* and the fastening groove 1103*a*.

Specifically, the second joint unit 110 of the connector structure 1 of the present disclosure further includes the second main body member 1100, the positioning member 1101, the second contact member 1102, the sleeve member 1103 and the buckle member 1104. The second main body member 1100 may be a hollow structure and have the through passage 1100*a*. The outer edge of the second main body member 1100 has the groove 1100*b*. The second main body member 1100 is detachably connected to the guide unit 111 through a screw or other locking structures, and the through passage 1100*a* communicates with the inside of the guide unit 111. The second main body member 1100 may be made of metal or plastic but is not limited thereto. The positioning member 1101 may be located in the through passage 1100*a*. The second contact member 1102 may be a metal conductor disposed at the positioning member 1101 and inside the second main body member 1100 and the guide unit 111. The buckle member 1104 may be a C-shaped structure and disposed in the groove 1100*b* of the second main body member 1100. The second main body member 1100 may be abutted against the fastening groove 1103*a* of the sleeve member 1103 through the buckle member 1104 so as to connect with the sleeve member 1103.

Therefore, when the first joint unit 100 and the second joint unit 110 connect with each other, the first joint unit 100 connects the connection unit 101 with the joint portion 1110 of the guide unit 111, so as to use the top abutment portions 1010*a* of the plurality of fasteners 1010 of the connection unit 101 to engage with the joint portion 1110 and use the limit unit 102 to engage with the joint portion 1110. Moreover, when the first joint unit 100 connects with the second main body member 1100, the first contact member 103 connects with the second contact member 1102.

It is worth mentioning that although the implementations, advantages and effects of the present disclosure can be understood by referring to the above descriptions, the above descriptions are merely one of the embodiments of the present disclosure and are not intended to limit the present disclosure.

Fourth Embodiment

Figure 12:
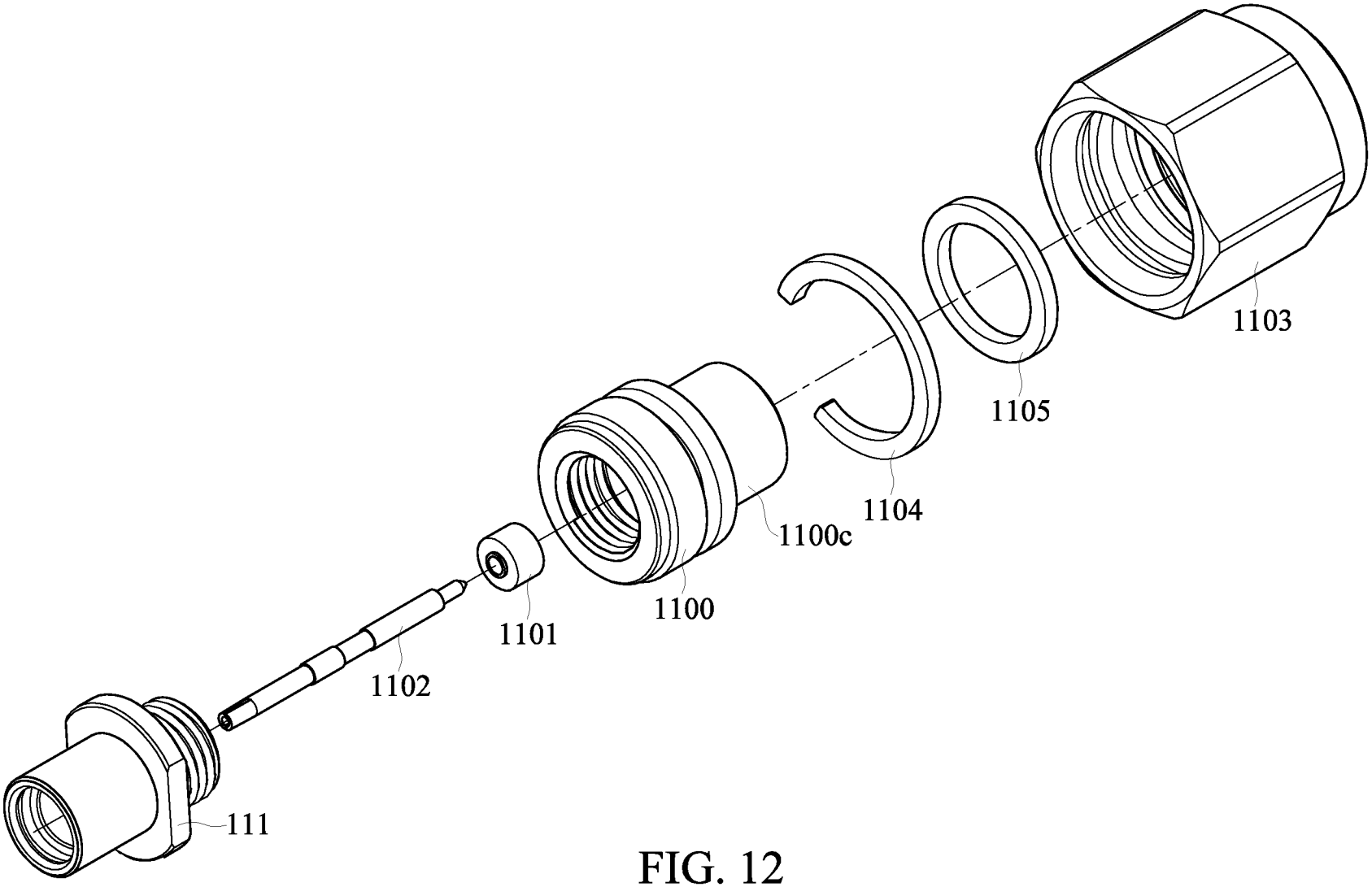
FIG. 12 is an exploded view of a connection module of a connector structure according to a fourth embodiment of the present disclosure.

FIG. 12 is an exploded view of a connection module of a connector structure according to a fourth embodiment of the present disclosure. Refer to FIG. 12 in conjunction with FIG. 1 to FIG. 11, the same components in the connector structure of this embodiment and those in the connector structure of the above embodiments have similar manners of operation, and details thereof will be omitted herein. It should be noted that in this embodiment, one end of the second main body member 1100 is detachably connected to the guide unit 111 and the other end of the second main body member 1100 has a protrusion portion 1100*c*. The second joint unit 110 further includes a protective member 1105 sleeved on the protruding portion 1100*c* and being an O-shaped structure.

For instance, one end of the second main body member 1100 of the connector structure 1 of the present disclosure is detachably connected to the guide unit 111 through a screw or other locking structures, and the other end of the second main body member 1100 protrudes outward to form the protrusion portion 1100*c*. The second joint unit 110 may further include the protective member 1105 which is an O-shaped structure and disposed at the protrusion portion 1100*c*. Therefore, when the second joint unit 110 is connected to an external cable (not shown in the drawings) through the sleeve member 1103, the protective member 1105 may serve as a cushioning member when the second main body member 1100 is in contact with the external cable.

It is worth mentioning that although the implementations, advantages and effects of the present disclosure can be understood by referring to the above descriptions, the above descriptions are merely one of the embodiments of the present disclosure and are not intended to limit the present disclosure.

Fifth Embodiment

Figure 13:
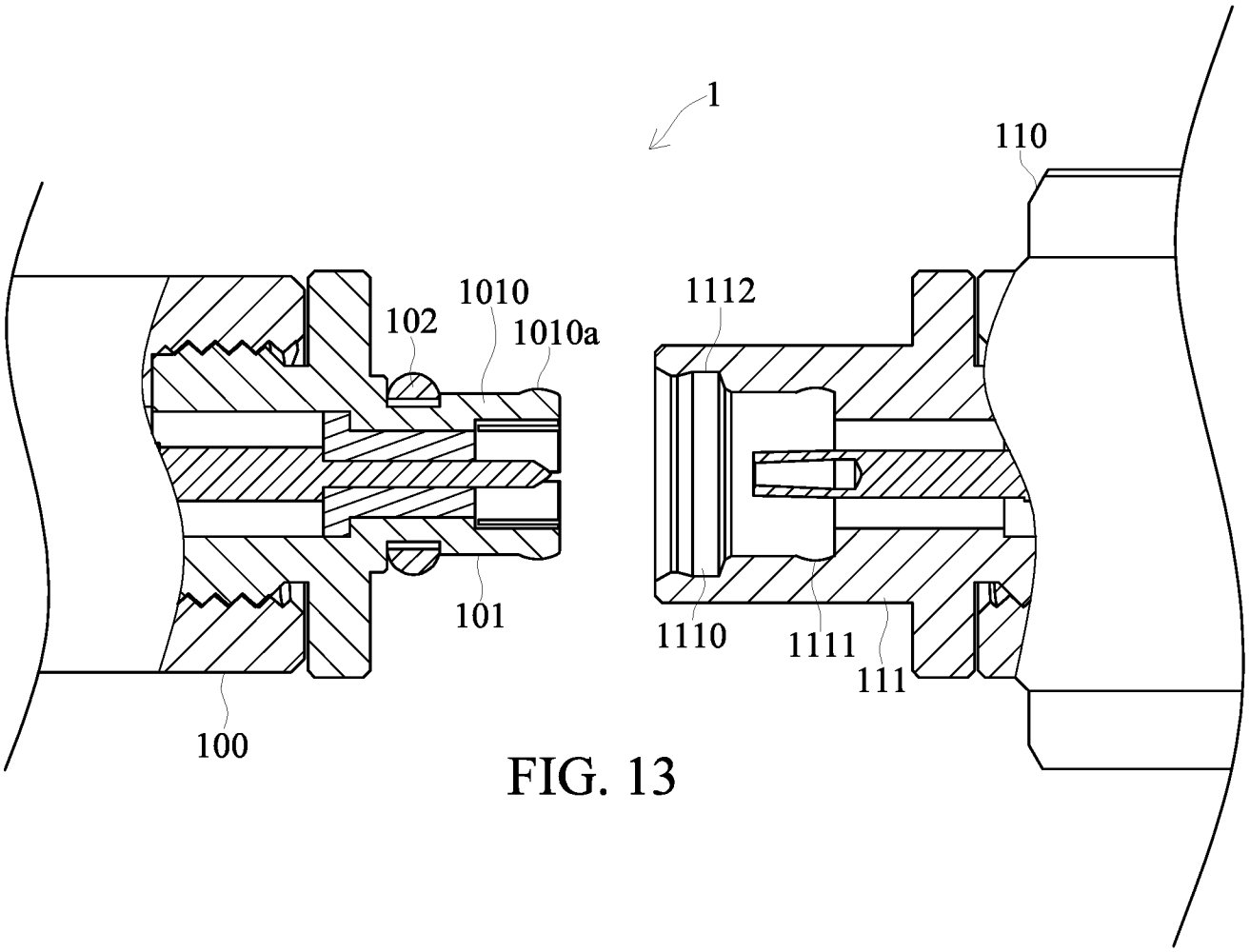
FIG. 13 is a cross-sectional view of a connector structure according to a fifth embodiment of the present disclosure.
Figure 14:
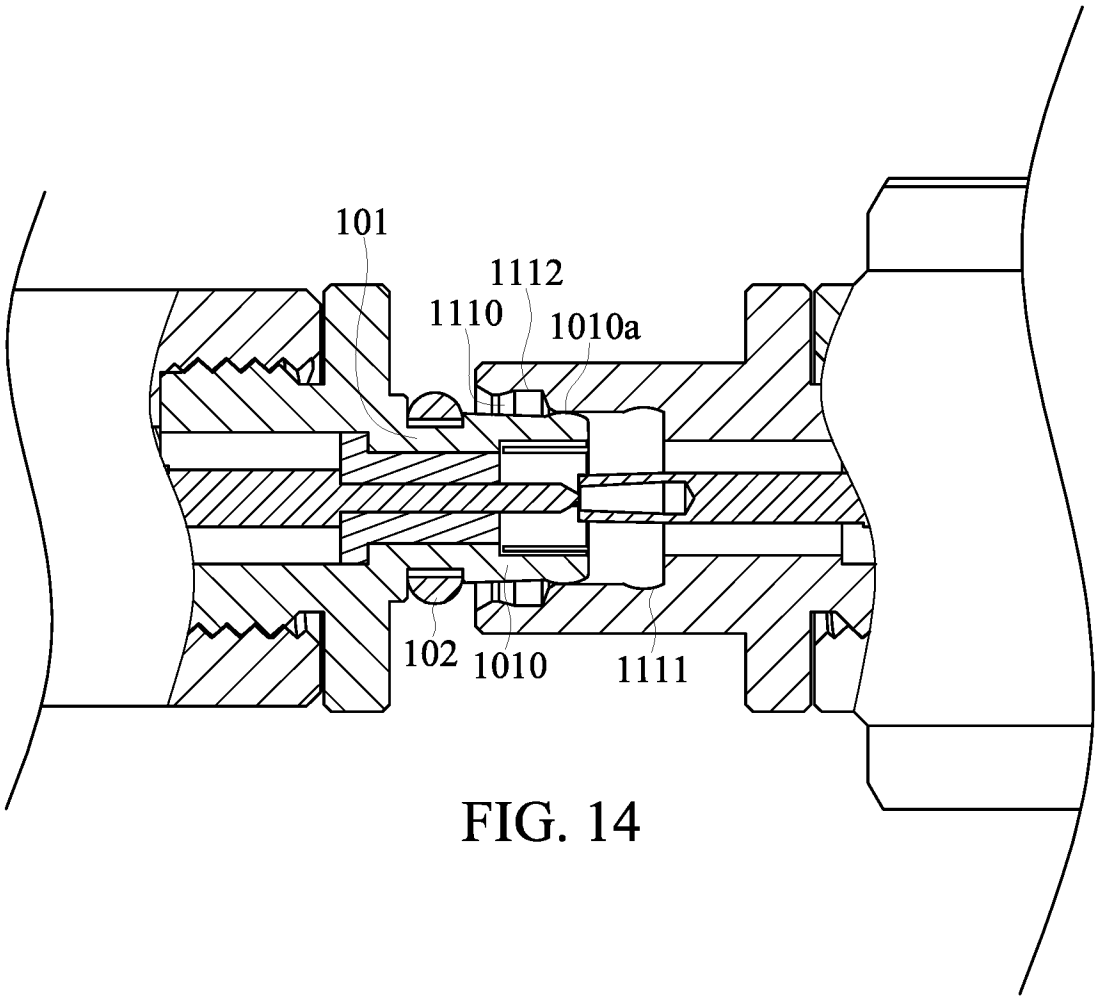
FIG. 14 is a cross-sectional view of the connector structure according to the fifth embodiment of the present disclosure.
Figure 15:
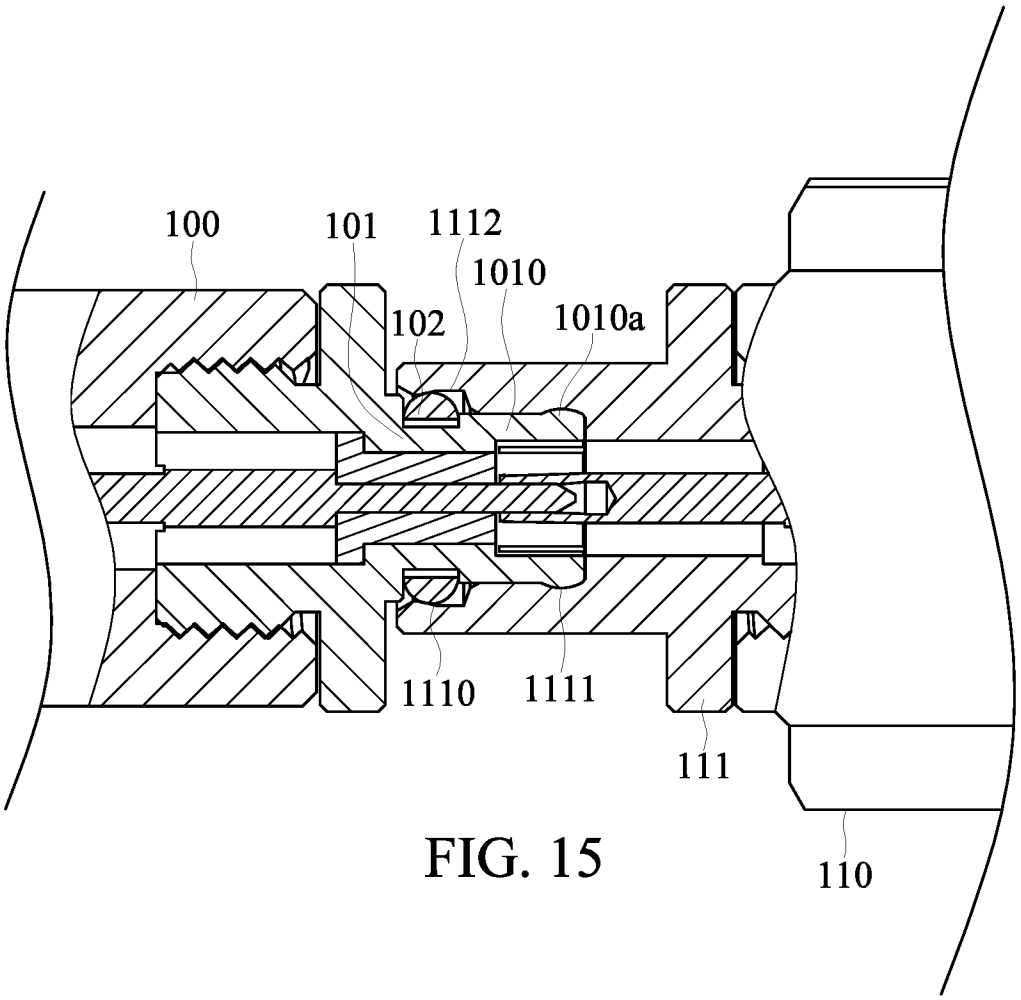
FIG. 15 is a cross-sectional view of the connector structure according to the fifth embodiment of the present disclosure.

FIG. 13 to FIG. 15 are cross-sectional views of a connector structure according to a fifth embodiment of the present disclosure. Refer to FIG. 13 to FIG. 15 in conjunction with FIG. 1 to FIG. 12, the same components in the connector structure of this embodiment and those in the connector structure of the above embodiments have similar manners of operation, and details thereof will be omitted herein. It should be noted that in this embodiment, the guide unit 111 further includes an abutment groove 1112 corresponding to the joint portion 1110. The connection module 10 is detachably connected to the joint portion 1110 through the connection unit 101 to allow the plurality of fasteners 1010 to be movably abutted against the abutment groove 1112 through the top abutment portions 1010*a*.

Specifically, the guide unit 111 of the present disclosure may further have the abutment groove 1112 corresponding to a joint opening 1110. Therefore, when the connection module 10 connects with the joint portion 1110 of the guide unit 111 through the connection unit 101, the plurality of fasteners 1010 of the connection unit 101 are elastically moved inward due to the abutment against the joint portion 1110 of the guide unit 111. After the connection unit 101 is completely connected to the joint portion 1110, the plurality of fasteners 1010 elastically move back, and the top abutment portions 1010*a* thereof are abutted against and firmly engaged with the abutment groove 1112. In addition, since the limit unit 102 and the joint portion 1110 are axially compressed, the limit unit 102 is firmly engaged with the joint portion 1110, so that the connection unit 101 and the guide unit 111 are firmly engaged.

Sixth Embodiment

Figure 16:
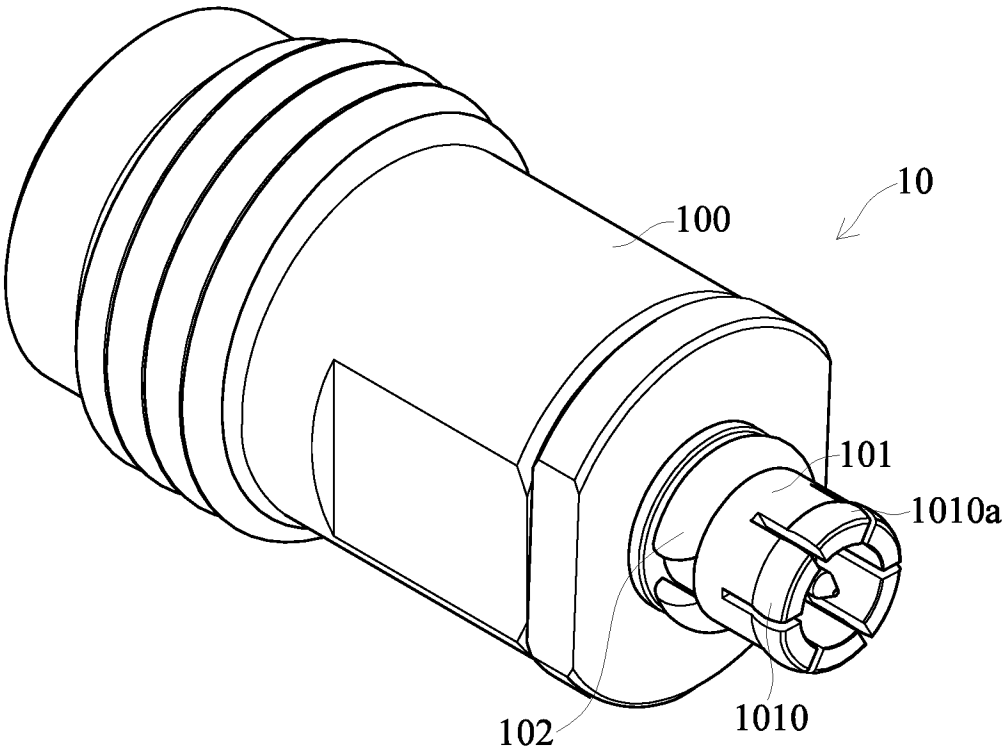
FIG. 16 is a perspective view of a connection module according to a sixth embodiment of the present disclosure.
Figure 17:
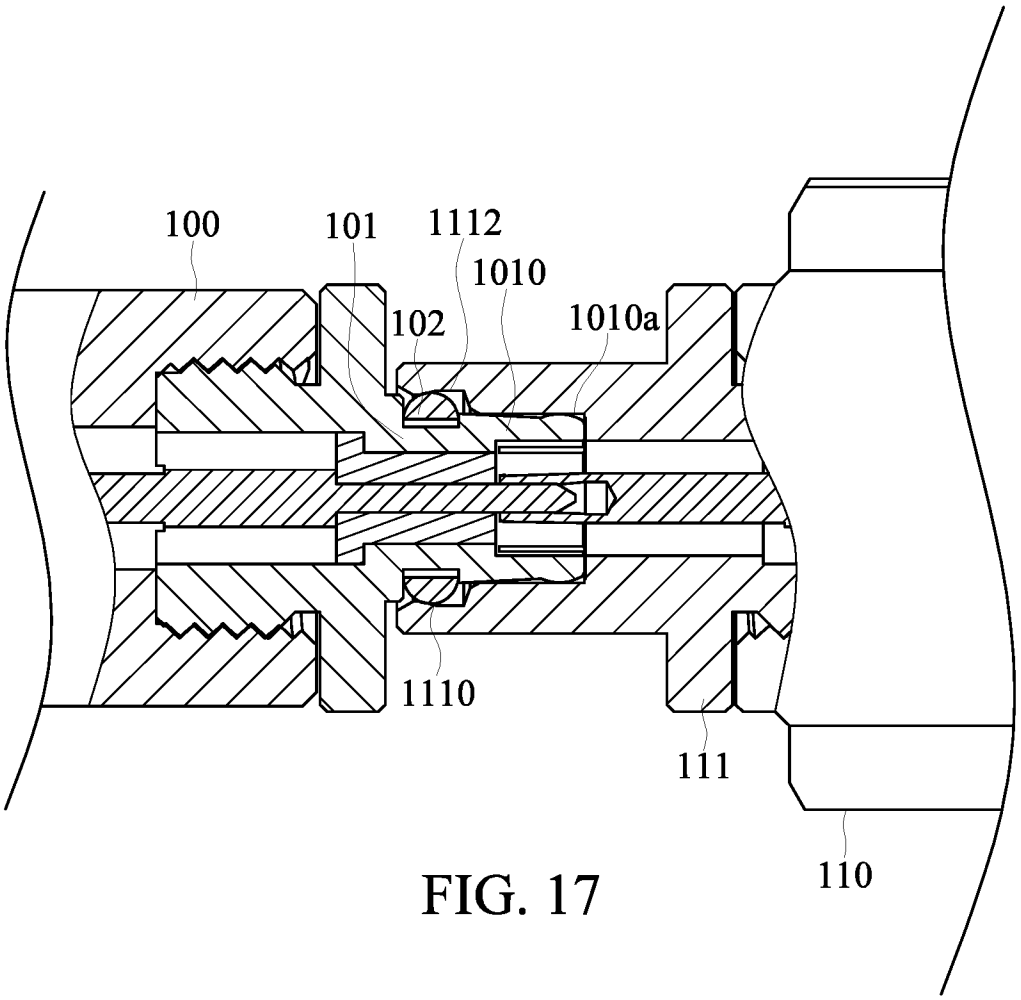
FIG. 17 is a cross-sectional view showing the connection module according to the sixth embodiment of the present disclosure.

FIG. 16 and FIG. 17 are respectively a perspective view and a cross-sectional view of a connection module according to a sixth embodiment of the present disclosure. Reference is made to FIG. 16 and FIG. 17 in conjunction with FIG. 1 to FIG. 15. The present disclosure provides the connection module 10 including the first joint unit 100, the connection unit 101 and the limit unit 102. One end of the connection unit 101 is detachably connected to the first joint unit 100 and the other end of the connection unit 101 has the plurality of fasteners 1010. The limit unit 102 is sleeved on the connection unit 101. The connection module 10 is detachably connected to the joint portion 1110 through the connection unit 101 so as to connect with the joint module 11, and the plurality of fasteners 1010 are movably abutted against the joint portion 1110 through the top abutment portions 1010*a*, and the limit unit 102 is abutted against the joint portion 1110.

Specifically, the connection module provided by the present disclosure includes the first joint unit 100, the connection unit 101 and the limit unit 102. One end of the connection unit 101 is detachably connected to the first joint unit 100, and the other end of the connection unit 101 has the plurality of fasteners 1010 (which may be clamp-shaped, but not limited thereto). The connection unit 101 may be made of metal or plastic but is not limited thereto. The limit unit 102 may be sleeved on the connection unit 101. The limit unit 102 is a C-shaped structure, but is not limited thereto.

Therefore, the connection module 101 is engaged with the joint module 11 by the connection unit 101 connected with the joint portion 1110 of the guide unit 111. During connection of the connection unit 101 with the joint portion 1110, the plurality of fasteners 1010 of the connection unit 101 are elastically moved inward due to the abutment against the joint portion 1110 of the guide unit 111. On the other hand, the plurality of fasteners 1010 can be abutted against the joint portion 1110 by the top abutment portions 1010*a* thereof with the elastic restoring force, thereby being firmly engaged with the joint portion 1110. In addition, since the limit unit 102 and the joint portion 1110 are axially compressed, the limit unit 102 is firmly engaged with the joint portion 1110, so that the connection unit 101 and the guide unit 111 are firmly engaged.

Accordingly, in the connection module 10 provided by the present disclosure, the connection unit 101 is used to improve the stability of the engagement of connection module 10 and the joint module 11, such that the rate and the quality of signal transmission can be improved and the frequency range of the connection module 10 can be in a high frequency range of DC to 67 GHz.

In a preferred embodiment, the connection unit 101 is a hollow structure and has the first fixing member 1011 having a hollow structure. The first joint unit 100 includes the first main body member 1001, the second fixing member 1002 and the first contact member 10003. The first main body member 1001 has the passage 1001*a*, and is detachably connected to the connection unit 101, the passage 1001*a* communicating with the inside of the connection unit 101. The second fixing member 1002 is located in the passage 1001*a*. The first contact member 103 is movably disposed at the first fixing member 1011 and the second fixing member 1002. The specific embodiment is similar to the above second embodiment, and is not described in detail herein.

It is worth mentioning that although the implementations, advantages and effects of the present disclosure can be understood by referring to the above descriptions, the above descriptions are merely one of the embodiments of the present disclosure and are not intended to limit the present disclosure.

Beneficial Effects of Embodiments

One of the beneficial effects of the present disclosure is that, with the technical solutions of "the connection module 10 includes a first joint unit 100, a connection unit 101 having one end detachably connected to the first joint unit 100 and the other end having a plurality of fasteners 1010, and a limit unit 102 sleeved on the connection unit 101, and the outer edge of each of the plurality of fasteners 1010 protrudes outward to form a top abutment portion 1010*a*," "the joint module 11 includes a second joint unit 110 and a guide unit 111 detachably connected to the second joint unit 110 and having a joint portion 1110," and "the connection module 10 is detachably connected to the joint portion 1110 through the connection unit 101 so as to connect with the joint module 11, and the plurality of fasteners 1010 are abutted against the joint portion 1110 through the top abutment portions 1010*a*, and the limit unit 102 is abutted against the joint portion 1110" in the connection module 10 and the connector structure 1 provided by the present disclosure, the connection module 10 and the joint module 11 can be firmly engaged so that the rate and quality of signal transmission can be improved.

Further, with the above structural design, in the connection module 10 and the connector structure 1 provided by the present disclosure, the stability of engagement of the connection module 10 and the joint module 11 is improved, so that when the coaxial cable is shaken or vibrated, a separation force between the connection module 10 and the joint module 11 will not be generated to cause loosening or poor contact. Accordingly, the rate and quality of signal transmission are improved, so that the frequency range can be in a high frequency range of DC to 67 GHz.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A connector structure, comprising:

a connection module including a first joint unit, a connection unit having one end detachably connected to the first joint unit and the other end having a plurality of fasteners, and a limit unit sleeved on the connection unit; wherein the outer edge of each of the plurality of fasteners protrudes outward to form a top abutment portion; and a joint module including a second joint unit and a guide unit detachably connected to the second joint unit and having a joint portion, wherein the guide unit is a hollow structure;

wherein the connection module is detachably connected to the joint portion through the connection unit so as to connect with the joint module, and the plurality of fasteners are abutted against the joint portion through the top abutment portions, and the limit unit is abutted against the joint portion;

wherein the connection unit is a hollow structure and has a first fixing member having a hollow structure, and the first joint unit includes:

a first main body member having a passage and detachably connected to the connection unit, wherein the passage communicates with the inside of the connection unit;

a second fixing member located in the passage; and a first contact member movably disposed at the first fixing member and the second fixing member.

2. The connector structure according to claim 1, wherein the second joint unit includes:

a second main body member having a through passage at the center, wherein the outer edge of the second main body member has a groove, the second main body member is detachably connected to the guide unit and the through passage communicates with the inside of the guide unit;

a positioning member located in the through passage;

a second contact member disposed at the positioning member and inside the through passage and the guide unit;

a sleeve member covering a portion of the second main body member and having a fastening groove at the inner wall surface thereof; and a buckle member located at the groove and the fastening groove.

3. The connector structure according to claim 2, wherein one end of the second main body member is detachably connected to the guide unit, the other end of the second main body member has a protruding portion, and the second joint unit further includes a protective member sleeved on the protruding portion and being an O-shaped structure.

4. The connector structure according to claim 1, wherein the limit unit is a C-shaped structure.

5. The connector structure according to claim 1, wherein the guide unit further includes an abutment groove; wherein the connection module is detachably connected to the joint portion through the connection unit to allow the plurality of fasteners to be movably abutted against the abutment groove through the top abutment portions.

6. A connection module, comprising:

a first joint unit;

a connection unit having one end detachably connected to the first joint unit and the other end having a plurality of fasteners; and a limit unit sleeved on the connection unit;

wherein the connection module is detachably connected to a joint portion of a joint module through the connection unit so as to connect with the joint module, the plurality of fasteners are movably abutted against the joint portion, and the limit unit is abutted against the joint portion;

wherein the connection unit is a hollow structure, and has a first fixing member having a hollow structure, and the first joint unit includes:

a first main body member having a passage and detachably connected to the connection unit, wherein the passage communicates with the inside of the connection unit;

a second fixing member located in the passage; and a first contact member movably disposed at the first fixing member and the second fixing member.

7. The connection module according to claim 6, wherein the limit unit is a C-shaped structure.

8. A connector structure, comprising:

a connection module including a first joint unit, a connection unit having one end detachably connected to the first joint unit and the other end having a plurality of fasteners, and a limit unit sleeved on the connection unit; wherein the outer edge of each of the plurality of fasteners protrudes outward to form a top abutment portion; and a joint module including a second joint unit and a guide unit detachably connected to the second joint unit and having a joint portion, wherein the guide unit is a hollow structure;

wherein the connection module is detachably connected to the joint portion through the connection unit so as to connect with the joint module, and the plurality of fasteners are abutted against the joint portion through the top abutment portions, and the limit unit is abutted against the joint portion;

wherein the second joint unit includes:

a second main body member having a through passage at the center, wherein the outer edge of the second main body member has a groove, the second main body member is detachably connected to the guide unit and the through passage communicates with the inside of the guide unit;

a positioning member located in the through passage;

a second contact member disposed at the positioning member and inside the through passage and the guide unit;

a sleeve member covering a portion of the second main body member and having a fastening groove at the inner wall surface thereof; and a buckle member located at the groove and the fastening groove.

* * * * *